US006234986B1

(12) United States Patent
Raffo et al.

(10) Patent No.: US 6,234,986 B1
(45) Date of Patent: May 22, 2001

(54) HAND-HELD WET/DRY SCULPTED MASSAGER THAT FLOATS

(75) Inventors: David M. Raffo, Chester (GB); Bjarki Haligrimsson; Rudy Anthony Vandenhelt, both of Ottawa (CA)

(73) Assignee: Headwaters Research & Development, Inc., Ottawa (CA)

( * ) Notice: Subject to any disclaimer, the term of this patent is extended or adjusted under 35 U.S.C. 154(b) by 0 days.

(21) Appl. No.: 09/178,217

(22) Filed: Oct. 23, 1998

(51) Int. Cl.[7] ..... A61H 7/00

(52) U.S. Cl. ..... 601/72; 601/67; 601/70; 601/46

(58) Field of Search ..... 601/46–48, 67–70, 601/72, 80, 84, 89, 136–138; 446/352, 297, 3, 484, 158, 153, 156, 162; 4/606; 43/1–3; 15/121, 117, 110

(56) References Cited

U.S. PATENT DOCUMENTS 1,668,785 * 5/1928 Smart ..... 43/1
2,391,475 * 12/1945 Newhardt ..... 43/2
2,494,631 * 1/1950 Risch ..... 43/2
3,585,990 * 6/1971 Blachly et al. ..... 601/72
3,705,578 * 12/1972 Cutler et al. ..... 601/73
4,566,214 * 1/1986 McCrory et al. ..... 43/3
4,713,037 * 12/1987 Tong ..... 446/158
4,732,049 * 3/1988 Beny et al. ..... 446/156
4,768,988 * 9/1988 Rutter ..... 446/153
5,353,461 * 10/1994 Enriquez ..... 15/97.1
5,471,695 * 12/1995 Aiyar ..... 601/72
5,582,581 * 12/1996 Horton ..... 601/70
5,775,022 * 7/1998 Sumrall et al. ..... 43/3
5,915,434 * 6/1999 Juarez ..... 15/114

* cited by examiner

*Primary Examiner*—Justine R. Yu
(74) *Attorney, Agent, or Firm*—Albert Peter Durigon

(57) ABSTRACT

A hand-held wet/dry sculpted massager that floats includes a pliant, sculpted first body providing a flotation bladder that is fixedly attached to a second body providing a vibratory motion imparter and battery receiving water-tight housing, to which a massage pad attachment and a cleaning sponge attachment are removably mounted by snap-fit.

16 Claims, 3 Drawing Sheets

FIG. 1
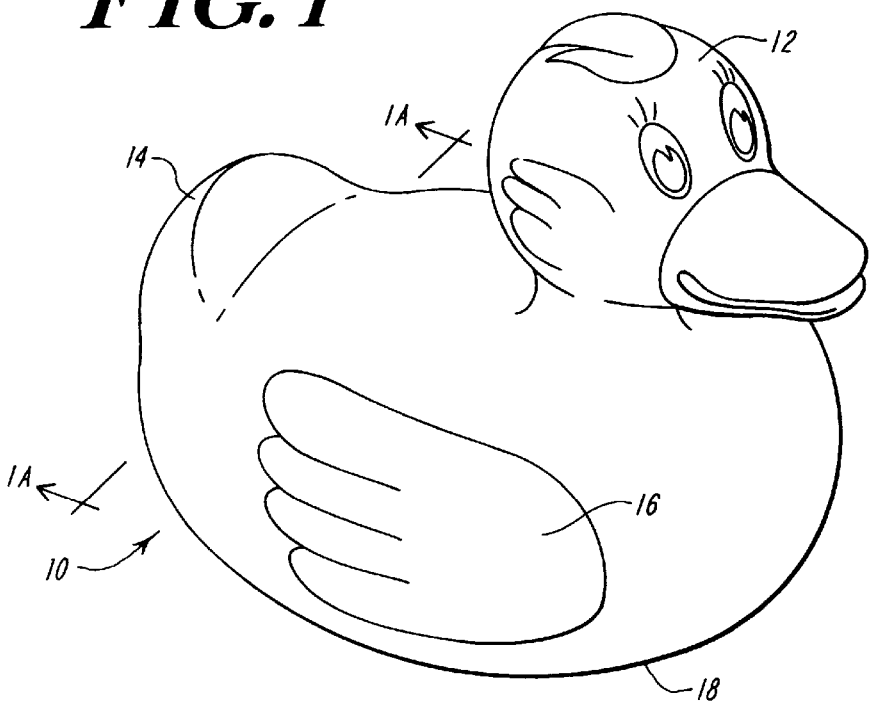
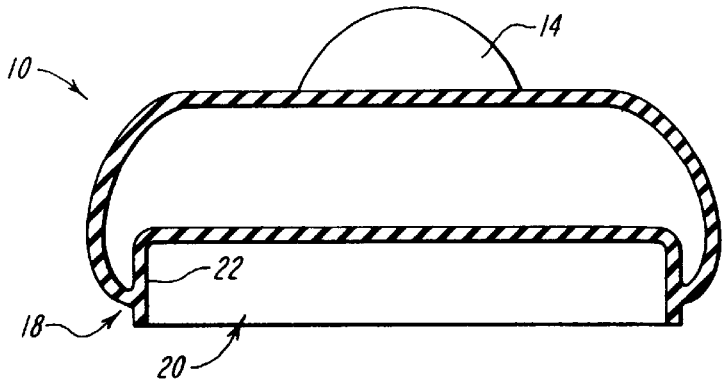
FIG. 1A

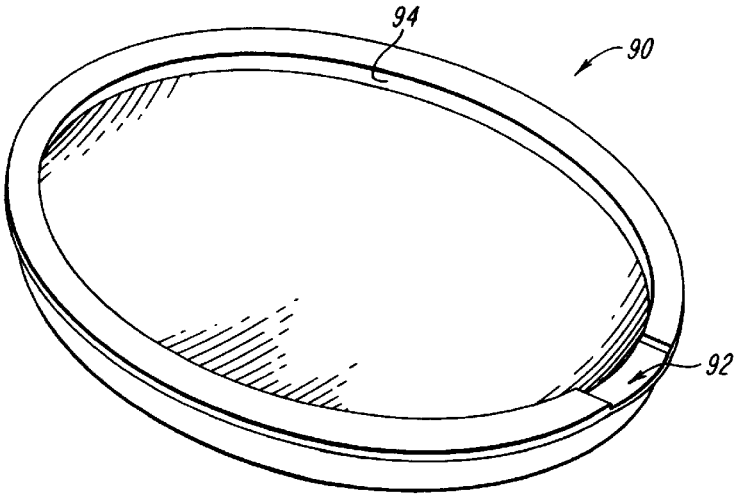
FIG. 4
FIG. 4A
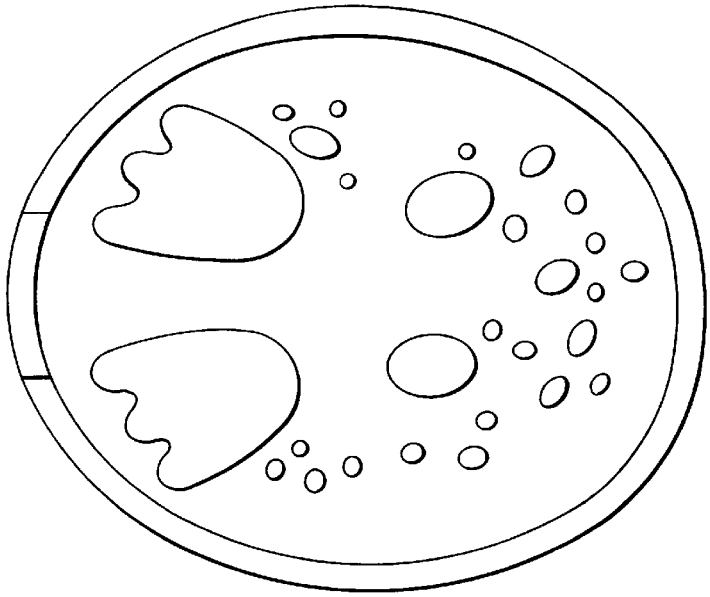
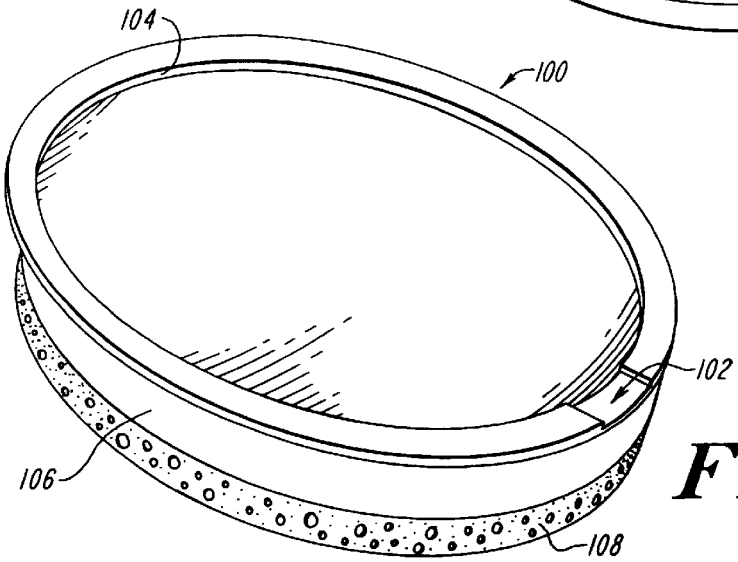
FIG. 5

HAND-HELD WET/DRY SCULPTED MASSAGER THAT FLOATS

FIELD OF THE INVENTION

This invention is drawn to the field of massagers, and more particularly, to a novel hand-held wet/dry sculpted massager that floats.

BACKGROUND OF THE INVENTION

The heretofore known massagers may be broadly classified as either wet or dry massagers depending on whether they have been designed to work in dry environments, such as the home or office, or wet ones, such as in the shower or bath. These wet or dry massagers typically included a vibratory motion imparter that was hand-held, strap-mounted or otherwise supported so as to enable contact with sore and tense muscles. The vibrations produced thereby tend to relax the sore and tense muscles in well-known manner and to impart an overall state of general relaxation.

The heretofore known massagers, however, generally have had their utility limited by being designed only for wet or dry environments, those designed for dry environments generally have been incapable of use in wet environments and those designed for wet environments generally have been poorly adapted for use in dry environments, which has required different massagers for different environments; have been generally inconvenient to use and costly to manufacture; and/or have had their relaxation effect only produced by vibrations alone.

SUMMARY OF THE INVENTION

Accordingly, it is a general object of the present invention to provide a novel hand-held massager that overcomes the disadvantages of the heretofore known wet or dry massagers.

It is a specific object of the present invention to provide a hand-held massager that is adapted for use in both wet and in dry environments, thereby overcoming the need to provide different massagers for different environments.

It is a related object of the present invention to provide a hand-held wet/dry massager that floats, which is particularly well-adapted for use in wet environments, such as in the bathtub or in the shower.

It is another related object of the present invention to provide a hand-held wet/dry massager that floats which is of modular construction, that, while providing entirely satisfactory use in both wet and dry environments, is comparatively inexpensive to manufacture.

It is a further related object of the present invention to provide a hand-held wet/dry massager that floats which is so sculpted as to provide an aesthetically pleasing visual aspect that not only serves as a bathroom or other ornament but which, during use, synergistically enhances the overall state of general relaxation that heretofore was produced by vibrations only.

It is another related object of the present invention to provide a hand-held wet/dry sculpted massager that floats which is adapted to receive one or more attachments that enhance the vibrations produced thereby, preferably an attachable massage tool, or achieve another function, preferably a cleaning function provided by an attachable cleaning tool.

In accord with these and other objects, the hand-held wet/dry sculpted massager that floats of the present invention includes a first body defining a flotation bladder, and a second body providing a vibratory motion imparter and battery receiving water-tight housing to which said first body is attached rendering the second body neutrally buoyant. A switch is mounted in water-tight sealing relation with said second body to control the application of power to the vibratory motion imparter. In the presently preferred embodiment, the first body defining a flotation bladder is sculpted of a pliant material, preferably rubber, in form of a duck having an upwardly and forwardly extending beaked head, an upwardly and rearwardly extending tail and side wings in positive relief. One or more attachments, preferably a soft plastic massage pad attachment having sculpted massage nodes in form of duck feet, and a cleaning sponge attachment, are removably mountable to the second body. In the presently preferred embodiment, each removable attachment is snap-fit mounted to said second body.

The hand-held wet/dry sculpted massager that floats of the present invention may be used in or out of the bath and floats in a balanced, upright manner with or without an attachment. In the bath, the vibrations produced thereby slowly move the massager when floating on the water. The attachments provide increased versatility; the soft plastic massage attachment enhances its massaging action, while the sponge attachment enables effective (and fun) cleaning, with or without vibrations. The hand-held wet/dry sculpted massager that floats of the present invention enables massage and/or washing of infants, or soothing, massaging and/or cleaning of stressed-out adults, and enables to provide relaxation and/or cleansing that is always fun-filled. Its pliant first body comfortably fits in the palm of an adult's hand, but is small and lightweight enough for children. The aesthetically pleasing visual and tactile aspects presented by the duck-shaped pliant first body cooperate with the vibrations produced by said second body to synergistically enhance the overall state of general relaxation in both wet and dry environments.

BRIEF DESCRIPTION OF THE DRAWINGS

These and other features, advantageous aspects and inventive objects of the present invention will become apparent as the invention becomes better understood by referring to the following solely exemplary detailed description of the presently preferred embodiment, and to the drawings, wherein:

FIG. 1 is a perspective view and

FIG. 1A is a sectional view showing the first body defining a flotation bladder of the hand-held wet/dry sculpted massager that floats of the present invention;

FIG. 4 is a perspective view and

FIG. 4A is a bottom plan view showing the massage tool attachment of the hand-held wet/dry sculpted massager that floats of the present invention; and FIG. 5 is a perspective view showing the cleaning tool attachment of the hand-held wet/dry sculpted massager that floats of the present invention.

DETAILED DESCRIPTION OF THE PRESENTLY PREFERRED EMBODIMENT

Figure 2:
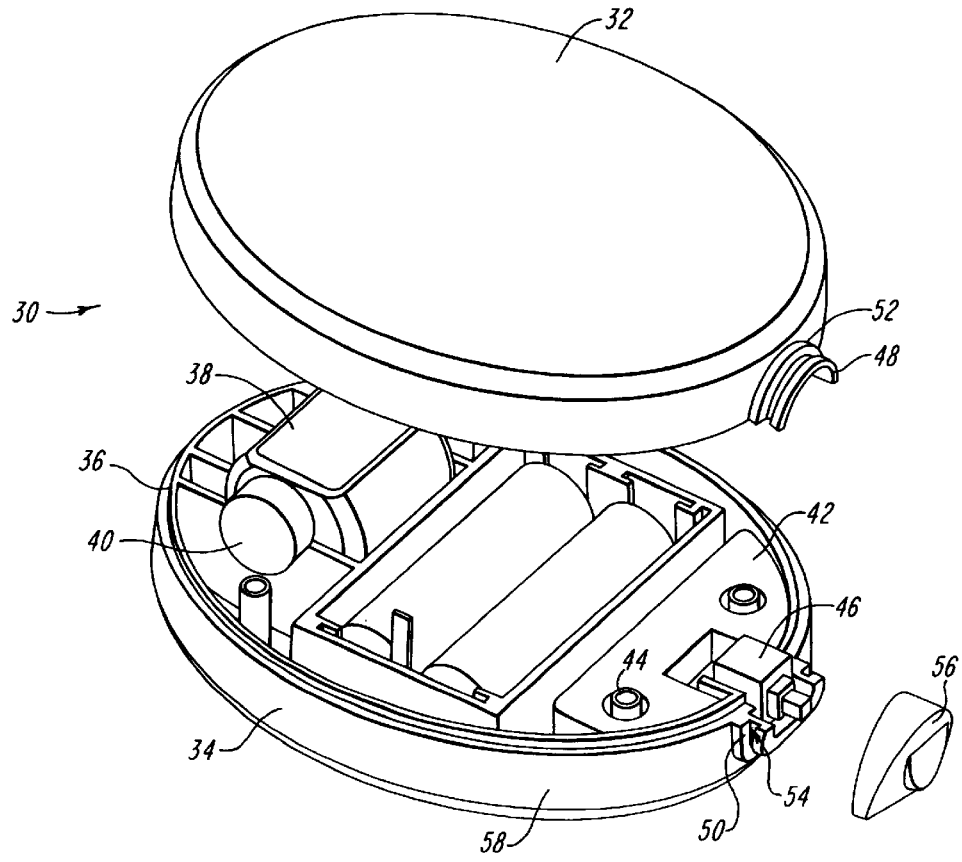
FIG. 2 is an exploded perspective view showing the second body providing a vibratory motion imparter and battery receiving water-tight housing of the hand-held wet/dry sculpted massager that floats of the present invention.

Referring now to FIG. 1, generally designated at 10 is a perspective view showing the first body defining a flotation bladder of the hand-held wet/dry sculpted massager that floats of the present invention. The first body 10 preferably is integrally Rotto-molded of a pliant material, preferably rubber, to provide a closed-on-itself and watertight flotation bladder. Other pliant or other materials may be employed, other molding techniques such as blow-molding may be employed, and other flotation bladder designs and techniques may be employed.

The pliant first body 10 preferably is integrally molded in the shape of a duck, having an upwardly and forwardly extending head 12, an upwardly and rearwardly extending tail 14 and side wings 16 in positive relief. Any other sculpted shape (as used herein, "sculpted" bears its broad sense of "formed into a three-dimensional work") may be employed.

The pliant first body 10 has a peripheral bottom rim 18 which defines an enclosed recess generally designated 20 in FIG. 1A, into which a second body providing a vibratory motion imparter and battery receiving water-tight housing to be described is received and fixedly attached. Preferably, as seen in FIG. 1A, the rim 18 is double-walled; when received in the recess, the second body is adhesively or otherwise fastened to the inner wall of the double-walled rim 18, allowing the outer wall 22- thereof to locally deform when the pliant first body is grasped and squeezed, which improves the overall "feel" of the pliant first body.

Referring now to FIG. 2, generally designated at 30 is an exploded perspective view showing the second body providing a vibratory motion imparter and battery receiving water-tight housing of the hand-held wet/dry sculpted massager that floats of the present invention. The second body 30 preferably is of modular construction and includes a lid member 32 that mates with a base member 34 to provide a water-tight housing. Preferably, the lid member 32 has a peripheral tongue, not shown, that mates with peripheral groove 36 provided on base member 34 in interfitting relation.

The lid and base members 32, 34 have walls cooperative to provide a vibratory motion imparter receiving compartment, into which motor 38 having eccentric weight 40 is fixedly mounted. The lid and base members 32, 34 have walls cooperative to provide a battery receiving compartment, into which two (2) AA batteries are removably inserted. A steel ballast member 42 is fixedly mounted in the base member 34 via threaded fasteners 44.

The lid and base members 32, 34 have walls cooperative to provide a switch receiving compartment, and a switch 46, preferably a post-click switch, is mounted in the switch receiving compartment provided therefor. Preferably, the switch 46 is mounted in position where it may readily be actuated, preferably under the tail of the pliant first body. Other locations where the switch 46 is easy to access and push with wet or dry hands may be employed.

A projection 48 is provided on lid member 32 that mates with a projection 50 provided on base member 34 to provide a switch cover receiving seat. The projections 48, 50 each have a channel generally designated 52, 54 that are in registration when the lid and base members 32, 34 are mated. A switch cover 56 preferably of pliant material such as rubber is received on the seat provided by the projections 48, 50 and adhesively mounted thereon in water-tight sealing relation. The channels 52,54 provide adhesive retention grooves. Other means to provide water-tight sealing of the switch 46 may be employed.

The switch 46 is electrically connected in well-known manner between the battery compartment and the vibratory motion imparter to control the application of battery power to the vibratory motion imparter.

The lid member 32 and the base member 34 are mated in water-tight sealing relation preferably by ultrasonic welding. An ultrasonic weld horn, not shown, is preferably provided that extends peripherally around the side wall of the flange defining the groove 36, down the side walls at points thereof on either side of the switch 46, and continues along the top of the projection 50. As will be appreciated, the ultrasonic weld horn, which runs continuously through three (3) planes in the area of switch 46, hermetically seals the lid member 32 and base member 34 in water-tight sealing relation. Other means to provide water-tight sealing of the second body providing a vibratory motion imparter and battery receiving housing may be employed.

Figure 3:
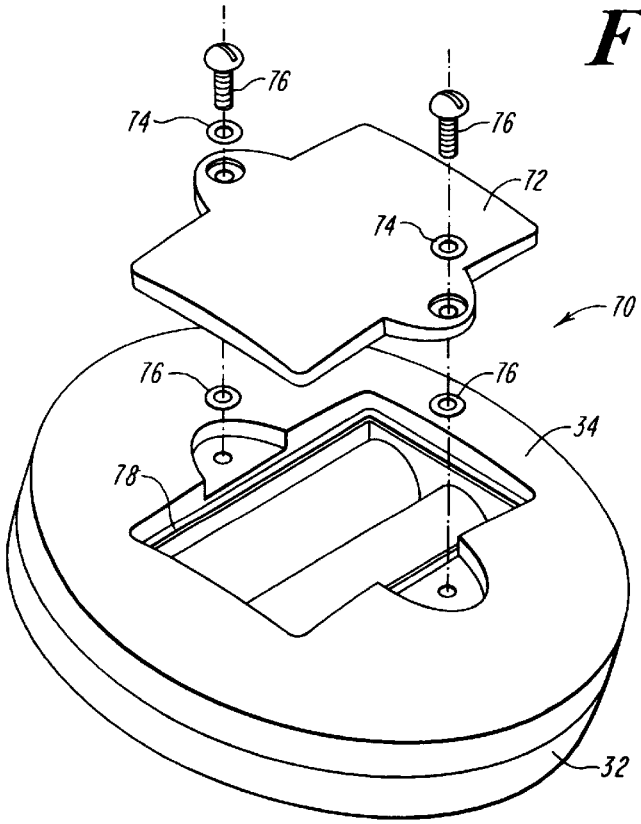
FIG. 3 is a perspective view showing a battery compartment door sealing subassembly of the second body of the hand-held wet/dry sculpted massager that floats of the present invention.

Referring now to FIG. 3, generally designated at 70 is an exploded perspective view showing the battery compartment sealing door subassembly of the hand-held wet/dry sculpted massager that floats of the present invention. The subassembly 70 includes a generally rectangular door 72 that is removably attached to base member 34 preferably by threaded fasteners 76. The battery compartment thereby is rendered child-proof while allowing straightforward battery replacement for adults.

O-rings 74 are provided to prevent water creep between the screw heads and the battery door, and O-rings 76 are provided to prevent water creep between the battery door attachment points and the base member 34. A die-cut gasket 78 is provided in a channel provided therefor in the base member 34 to prevent water creep between the base member and the battery door 72. Other means may be employed to removably attach battery door 72 to the base member 34 in water-tight sealing relation.

Referring now to FIG. 4, generally designated at 90 is a perspective view showing the massage pad attachment of the hand-held wet/dry sculpted massager that floats of the present invention. The massage pad attachment 90 is integrally molded of a soft plastic material in the shape of a shallow cup to a depth that is adapted to allow reception of the base member 34 (FIG. 2) of the second body 30 (FIG. 2). Its outer surface is sculpted preferably to present duck feet in positive relief, as seen in FIG. 4A, which provide "bubble nodes" for massaging; it has an indent 92 into which the pliant switch cover 48 (FIG. 2) is seated; and its peripheral wall is circumferentially beveled to define an undercut generally designated 94. The circumferential undercut 94 cooperates with an undercut 58 (FIG. 2) circumferentially provided about base member 34 (FIG. 2) to removably mount the massage pad attachment 90 on and off of the base member 34 (FIG. 2) by snap-fit. Other means to removably attach the massage pad tool attachment 90 may be employed.

Referring now to FIG. 5, generally designated at 100 is a perspective view showing the cleaning attachment of the hand-held wet/dry sculpted massager that floats of the present invention. The cleaning attachment 100 is integrally molded of a soft plastic material in the shape of a shallow cup to a depth that is adapted to allow reception of the base member 34 (FIG. 2) of the second body 30 (FIG. 2). It has an indent 102 into which the pliant switch cover 48 (FIG. 2) is seated; its peripheral wall is circumferentially beveled to define an undercut generally designated 104; and it is provided with a circumferential flange 106 that defines a cavity into which a soft cleaning sponge 108 is adhesively or otherwise mounted. The circumferential undercut 104 cooperates with the undercut 58 (FIG. 2) circumferentially provided about base member 34 (FIG. 2) to removably mount the cleaning tool attachment 100 on and off of the base member 34 (FIG. 2) by snap-fit. Other means to removably attach the cleaning tool attachment 100 may be employed.

Many modifications of the presently disclosed invention will become apparent to those of skill in the art without departing from the inventive concepts.

What is claimed is:

1. A hand-held wet/dry sculpted massager that floats, comprising:

a water-tight first neutrally buoyant sculpted body defining a self-enclosed flotation bladder;

a water-tight second negatively buoyant body having a first compartment for receiving a vibratory motion imparter and a second compartment for receiving at least one battery, to which said water-tight first neutrally buoyant body defining a self-enclosed flotation bladder is attached, rendering the water-tight second negatively buoyant body neutrally buoyant in a liquid medium;

a vibratory motion imparter including a motor having an eccentric weight mounted in said first compartment of said water-tight second negatively buoyant body; and a switch electrically connected between said second battery receiving compartment and said vibratory motion imparter that is mounted in water-tight sealing relation with said water-tight second negatively buoyant body to control the application of power to said vibratory motion imparter mounted in said first compartment of said water-tight second negatively buoyant body.

2. The hand-held wet/dry sculpted massager that floats of claim 1, wherein said first body defining a flotation bladder is sculpted of a pliant material.

3. The hand-held wet/dry sculpted massager that floats of claim 2, wherein said pliant material is rubber and wherein said first body is sculpted in form of a duck having an upwardly and forwardly extending beaked head, an upwardly and rearwardly extending tail and side wings in positive relief.

4. The hand-held wet/dry sculpted massager that floats of claim 2, wherein the pliant first body has a peripheral bottom rim which defines an enclosed recess into which said second body providing a vibratory motion imparter and battery receiving water-tight housing is received and fixedly attached.

5. The hand-held wet/dry sculpted massager that floats of claim 4, wherein said peripheral rim is double-walled; when received in said recess, said second body is fastened to the inner wall of said double-walled rim, allowing the outer wall thereof to locally deform when said pliant first body is grasped and squeezed.

6. The hand-held wet/dry sculpted massager that floats of claim 1, further including a tool attachment, and wherein said second body has an exposed face to which said tool attachment is removably mounted.

7. The hand-held wet/dry sculpted massager that floats of claim 6, wherein said tool attachment is snap-fit on and off of said exposed face of said second body.

8. The hand-held wet/dry sculpted massager that floats of claim 7, wherein said tool attachment is a massage pad attachment.

9. The hand-held wet/dry sculpted massager that floats of claim 8, wherein said massage pad attachment is integrally formed of a soft plastic material.

10. The hand-held wet/dry sculpted massager that floats of claim 9, wherein said soft plastic massage pad attachment has sculpted massage nodes in form of duck feet.

11. The hand-held wet/dry sculpted massager that floats of claim 6, wherein said tool attachment is a cleaning attachment.

12. The hand-held wet/dry sculpted massager that floats of claim 1, wherein said second body includes a lid member that mates with a base member in interfitting relation.

13. The hand-held wet/dry sculpted massager that floats of claim 12, wherein said lid member and said base member are mated in water-tight sealing relation by ultrasonic welding.

14. The hand-held wet/dry sculpted massager that floats of claim 1, wherein a ballast member is fixedly mounted in said second body.

15. The hand-held wet/dry sculpted massager that floats of claim 1, further including a battery compartment door; and means for removably mounting said battery compartment door in water-tight sealing relation with said second body to allow insertion and replacement of batteries and waterproof operation.

16. A hand-held wet/dry sculpted massager that floats, comprising:

a first sculpted body of a pliant material defining a flotation bladder having a peripheral double-walled bottom rim which defines an enclosed recess and which has outer and inner walls;

a second body having a first compartment for receiving a vibratory motion imparter and a second compartment for receiving at least one battery, which is inserted into said recess of said first body and attached to the inner wall of the double-walled bottom rim rendering the second body neutrally buoyant in a liquid medium and allowing the outer wall to locally deform when said first body of pliant material is grasped and squeezed;

a vibratory motion imparter including a motor having an eccentric weight mounted in said first compartment of said second body; and a switch electrically connected between said battery receiving compartment and said vibratory motion imparter that is mounted in water-tight sealing relation with said second body to control the application of power to said vibratory motion imparter.

* * * * *